US006220370B1

(12) United States Patent
Wesson et al.

(10) Patent No.: US 6,220,370 B1
(45) Date of Patent: Apr. 24, 2001

(54) CIRCULATING GUN SYSTEM

(75) Inventors: David S. Wesson, DeSoto, TX (US); Gabe Williger, Gretna, LA (US); Lyle W. Andrich, Ft. Worth, TX (US)

(73) Assignee: Owen Oil Tools, Inc., Fort Worth, TX (US)

( * ) Notice: Subject to any disclaimer, the term of this patent is extended or adjusted under 35 U.S.C. 154(b) by 0 days.

(21) Appl. No.: 09/433,034

(22) Filed: Oct. 28, 1999

Related U.S. Application Data

(60) Provisional application No. 60/120,735, filed on Feb. 18, 1999.

(51) Int. Cl.[7] ..... E21B 43/117

(52) U.S. Cl. ..... 175/4.52; 175/4.56; 166/55.1; 166/297; 102/320; 102/323

(58) Field of Search ..... 166/55, 55.1, 297; 175/4.52, 4.56; 102/320, 323

(56) References Cited

U.S. PATENT DOCUMENTS 4,479,556 * 10/1984 Stout et al. ..... 175/4.6
4,564,076 * 1/1986 Vann et al. ..... 175/4.52
4,566,538 1/1986 Peterson ..... 166/278
4,633,945 1/1987 Upchurch ..... 166/55.1
4,944,348 7/1990 Whiteley et al. ..... 166/278
5,322,019 * 6/1994 Hyland ..... 102/312
5,829,538 11/1998 Wesson et al. ..... 175/4.6

* cited by examiner

*Primary Examiner*—Roger Schoeppel
(74) *Attorney, Agent, or Firm*—Charles D. Gunter, Jr.

(57) ABSTRACT

A tubing conveyed perforating apparatus is shown which includes a tubular firing section which carries a plurality of explosive charges. The explosive charges are initially aligned with regions of reduced wall area provided in a tubular firing section which initially surrounds the charges. A piston sleeve is mounted on the exterior of the firing section. The piston sleeve has a plurality of apertures which are initially aligned with the regions of reduced wall area in the tubular firing section and thus with the explosive charges. Detonation of the charges causes the piston sleeve to shift so that the piston sleeve apertures are out of alignment with openings formed in the tubular firing section by the detonation of the charges, thereby trapping any resulting debris within the interior of the tubular firing section. Firing of the explosive charges opens upper and lower circulating ports so that sand or other debris can be reverse circulated up the interior of the well string to the well surface. A piston actuated retrieving head can be utilized to engage and retrieve a sealing plug from a sump packer within the well bore.

22 Claims, 4 Drawing Sheets

CIRCULATING GUN SYSTEM

This application claims the benefit of U.S. Provisional Application Ser. No. 60/120,735, filed Feb. 18, 1999.

BACKGROUND OF THE INVENTION

1. Field of the Invention

The present invention relates generally to a tubing conveyed perforating gun system of the type used to perforate a well bore for the production of well bore fluids, and, specifically, to such a system with internal components designed to decrease firing debris and to allow reverse washing of fill encountered in the well bore, without tripping the system out of the well.

2. Description of the Prior Art

As oil and gas wells are being drilled, the integrity of the borehole is preserved by cementing a casing or liner in place in the borehole. The casing or liner is a metal cylindrical conduit which must be punctured or perforated over the desired production interval in order to produce well bore fluids once drilling is complete. A perforating gun which utilizes some form of fired projectile and an explosive charge is used to perforate the casing or liner to begin production from the well.

Prior perforating gun techniques have either utilized tools which were run on a wireline or cable or have utilized tubing conveyed devices which were run on a tubing string to a desired depth in a well bore. Tubing conveyed devices have certain advantages over wireline methods. For example, tubing conveyed devices allow safe, immediate release of formation pressure at maximum pressure differentials into the tubing string. With tubing conveyed perforating systems, the tubing can be run into position, a packer set to seal off the well bore, and the surface wellhead equipment can be installed. The packer setting can be checked by circulating fluid under pressure through the well annulus or through the well tubing string. Once the surface work is completed and tested for safety, the perforating gun can be fired to bring in the well. Tubing Conveyed Perforating (TCP) systems provide rig time savings, higher shot density, greater gun length and the ability to perforate "under balanced" so that perforations are cleansed through formation fluid backflow. Since perforating guns can be run below the production tubing they enable the well to be perforated and completed, i.e., put into production, in one operation.

Occasionally, sand fill has infiltrated into the well and causes problems with gravel packing or other well bore operations. It is thus desirable to provide an apparatus having the capability of reverse circulating the fill out of the well. Obviously, it is desirable to accomplish the reverse circulation of the fill out of the well without having to pull the work string, gravel packing and/or perforating apparatus.

In wells utilizing a sump packer below the zone to be perforated, it is necessary for the perforating string to have its lower end sealingly engaged with a bore of the sump packer prior to performing the desired well bore operation. With the prior art systems, if sand fill was encountered on top of the sump packer, it was generally necessary to trip the perforating apparatus and its associated tool string out of the well. A work string was then run into the well to reverse circulate the sand fill away from the sump packer. The work string was then required to be tripped out of the well so that the perforating tool string could again be run into the well. Often times, as many as three trips in and out of the well were required before the entire operation could be accomplished.

The present invention has as one object to provide a tubing conveyed perforating apparatus with means for reducing the accumulation of firing debris within the well bore at the conclusion of the firing operation.

Another object of the invention is to provide such an apparatus which allows for the reverse circulation of sand fill encountered within the well bore, such as sand fill encountered directly on top of a sump packer located within the well bore.

Another object of the invention is to provide a tubing conveyed perforating apparatus which allows the plug in a sump packer to be placed and released, perforation of the well casing, reverse circulation of fill and/or debris from the top of the sump packer, and subsequent retrieval of the plug from the sump packer.

Another object of the invention is to provide such an apparatus which is relatively simple in design and economical to manufacture.

SUMMARY OF THE INVENTION

The tubing conveyed perforating apparatus of the invention is used in perforating a surrounding well bore. The apparatus comprises a tubular assembly made up of a plurality of tubular sections. The tubular sections present a generally cylindrical exterior and a concentric interior bore. The tubular assembly has an upper connecting end for connection in tubing string extending to the well surface and a lower end. At least one of the selected tubular sections comprises a tubular firing section having a plurality of explosive charges carried therein. Each of the explosive charges is initially aligned with a region of reduced wall area provided within the tubular firing section surrounding the charges. A piston sleeve is mounted on the exterior of the tubular firing section. The piston sleeve has a plurality of apertures therein which are initially aligned with the regions of reduced wall area in the tubular firing section and thus with the explosive charges. A firing means is located within the tubular assembly for detonating the explosive charges to perforating the surrounding well bore. The piston sleeve includes a piston area which communicates by means of an internal port with the interior bore of the tubular firing section. Detonation of the firing means applies a force to the piston area to shift the piston sleeve, thereby moving the piston sleeve apertures out of alignment with openings formed in the tubular firing section due to detonation of the explosive charges. This action serves to trap any resulting explosive debris within the interior bore of the tubular firing section.

In addition to utilizing the force of explosive gases to shift the piston sleeve, well hydrostatic pressure can be utilized to apply a force to the piston area to shift the piston sleeve, the well hydrostatic pressure being communicated to the interior bore of the tubular firing section upon detonation of the explosive charges. Detonation of the explosive charges creates openings in the tubular firing section at the regions of reduced wall area, thereby forming a temporary flow path to the interior bore of the tubular firing section.

Preferably, a plurality of tubular firing sections are connected end-to-end in the tubular assembly, the firing sections being connected by ignition means for detonation by the firing means.

The lower end of the tubular assembly can carry a sealing plug which is designed to seat within a mating bore of a sump packer located within the well bore. The sealing plug is preferably connected to the lower end of the tubular assembly by a shear means, whereby setting weight on the tubing string shears the shear means to release the lower end of the tubular assembly from the sealing plug. A piston actuated retrieving assembly can be located within the lower end of the tubular assembly above the sealing plug. The piston actuated retrieving assembly has a reactive piston area which is exposed to forces applied by the firing of the explosive charges and/or well hydrostatic pressure to shift the retrieving assembly downwardly within the lower end of the tubular assembly. The lower end of the tubular assembly can also be provided with one or more bottom circulation ports for ultimately communicating the interior bore of the tubular assembly with the surrounding well annulus. Movement of the piston actuated retrieving assembly downwardly within the tubular assembly serves to uncover the bottom circulation ports.

The piston actuated retrieving assembly preferably includes a fishing head at a lower extent thereof which includes a colleted opening for engaging a mating surface provided on the sealing plug for retrieving the sealing plug from the bore of the sump packer. The piston actuated retrieving assembly includes an intermediate length between the reactive piston area and the fishing head, the intermediate length being provided with a latch means for locking the retrieving assembly in a lower, shifted position.

In the method of the invention, a perforating apparatus is run on a tubing string into a well bore having a sump packer located at a selected subterranean location. The sump packer has a packer bore therethrough. The perforating apparatus carried by the tubing string includes a plurality of tubular sections having generally cylindrical exteriors and concentric interior bores, at least one of the tubular sections comprising a tubular firing section having a plurality of explosive charges therein. The lower end of the tubular assembly is provided with a sealing plug which is designed to seat within the bore of the sump packer located within the well bore.

The sealing plug is connected to the lower end of the tubular assembly by a shear means, whereby setting weight on the tubing string shears the shear means to release the lower end of the tubular assembly from the sealing plug. The assembly is also provided with the piston actuated retrieving assembly and bottom circulation port, as previously described, which are used after the perforating operation.

The well tubing string is lowered downwardly within the well bore until the sealing plug is received within the sump packer bore. By continuing to apply downward weight on the tubing string, the shear means is sheared to release the lower end of the tubular assembly from the sealing plug. The tubing string is then typically picked up a few feet and the explosive charges are detonated to perforating the desired production interval and simultaneously shift the piston actuated retrieving assembly downward within the lower end of the tubular assembly. Downward movement of the retrieving assembly serves to uncover the bottom circulation port.

The assembly can then be lowered downwardly while washing any accumulated debris or sand from off the sump packer by reverse circulating fluid down the well annulus, through the bottom circulation port and up the interior bore of the assembly and tubing string to the well surface.

The assembly can be lowered further downwardly until the fishing head of the retrieving assembly engages the sealing plug. Pulling the assembly upwardly pulls the engaged sealing plug upwardly out of the packer bore.

Additional objects, features and advantages will be apparent in the written description which follows.

DETAILED DESCRIPTION OF THE INVENTION

Figure 1:
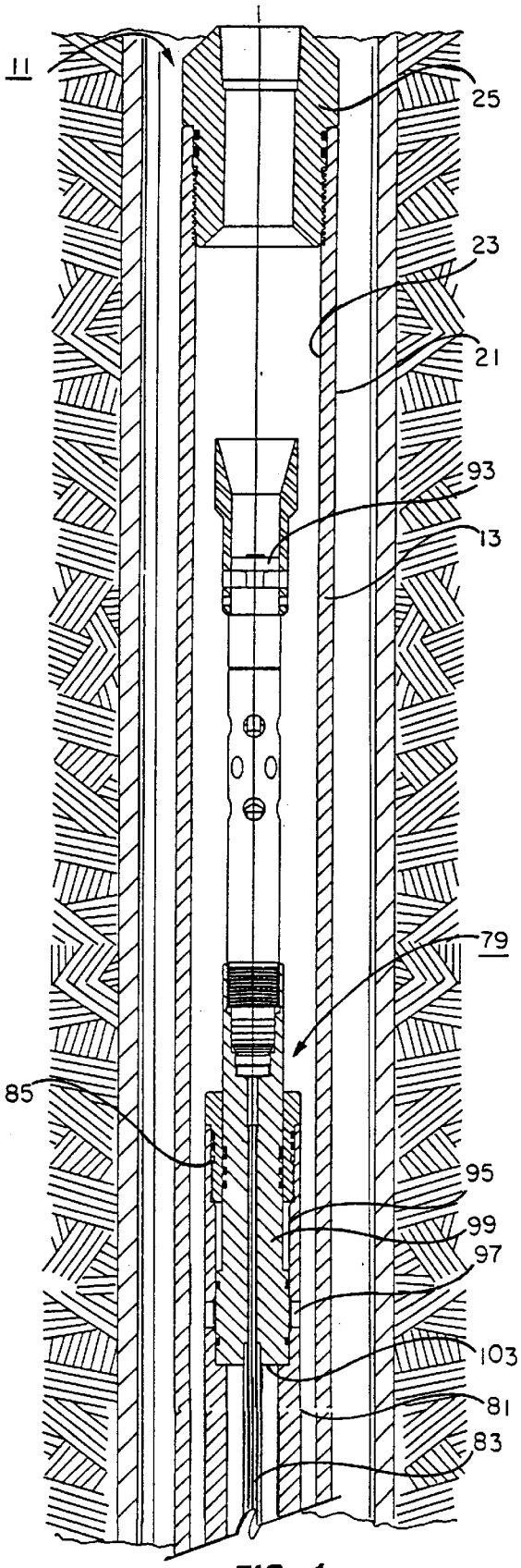
FIG. 1 is a side, cross-sectional view of the upper end of the tubing conveyed perforating apparatus of the invention showing a portion of the firing head thereof in the running-in position within a well bore.

FIGS. 1–4 illustrate a tubing conveyed perforating apparatus of the invention, designated generally as 11. Each of the downward continuing sequence of views illustrates the respective components of the apparatus in the running-in position, prior to firing the explosive charges. The apparatus 11 includes a tubular assembly made up of a plurality of tubular sections 13, 15, 17, 19. Each tubular section has a generally cylindrical exterior 21 and a generally concentric interior bore 23. The tubular assembly has an upper connecting end 25 for connection in the tubing string (not shown) leading to the well surface and the assembly has a lower end (27 in FIG. 4).

Figure 3:
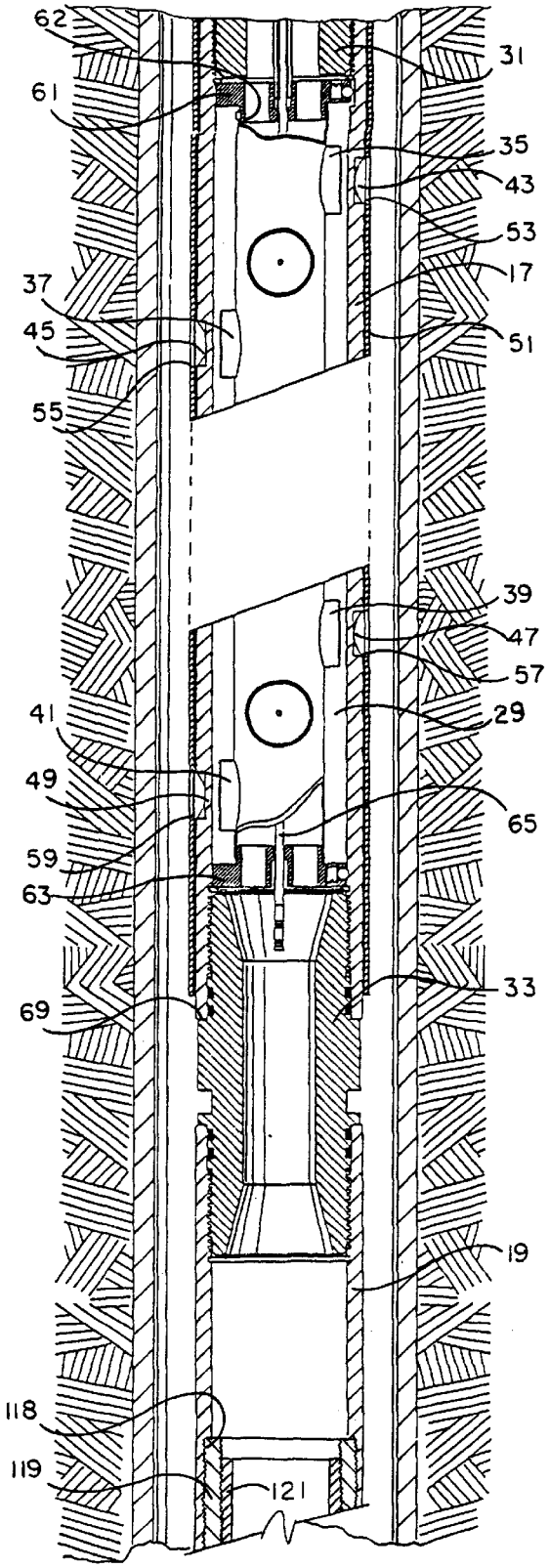
FIG. 3 is a downward continuation of FIG. 2 primarily showing the tubular firing section of the apparatus including the shaped charges and shape charge holder thereof.

With reference to FIG. 3, at least one selected tubular section 17 comprises a tubular firing section having an elongate charge holder 29 located between an upper connector 31 and a lower connector 33 thereof. A plurality of explosive charges, e.g., charges 35, 37, 39, 41, are mounted on the charge holder 29. The charges are arranged in a selected pattern and orientation for producing the desired perforating pattern upon detonation.

While the explosive charges 35, 37, 39, 41 are shown mounted in tubular charge holder, it will be understood that other means can be utilized for supporting or mounting the charges within the tubular firing section. For example, U.S. Pat. Nos. 5,638,901 and 5,662,178, both assigned to the assignee of the present invention, show "spiral strips" for supporting explosive charges within a surrounding tubular firing section. U.S. Pat. No. 5,829,538, also assigned to the assignee of the present invention, shows an explosive charge arrangement in which the support means is comprised of disintegratable materials. Other arrangements will be familiar to those skilled in the relevant arts.

The tubular firing section 17 which surrounds the charge holder 29 is provided with regions of reduced wall area or cross sectional thickness 43, 45, 47, 49. These regions are initially aligned with the explosive charges mounted on the charge holder 29. The regions of reduced wall area will be penetrated by the explosive charges upon detonation by the firing means, as will be discussed below. The thickness of the regions of reduced wall area is selected to initially seal off the interior of the tubular firing section and maintain the integrity thereof, while also being puncturable by the explosive charges without leaving a "burr" which would interfere with subsequent movement of the piston sleeve 51.

Figure 3A:
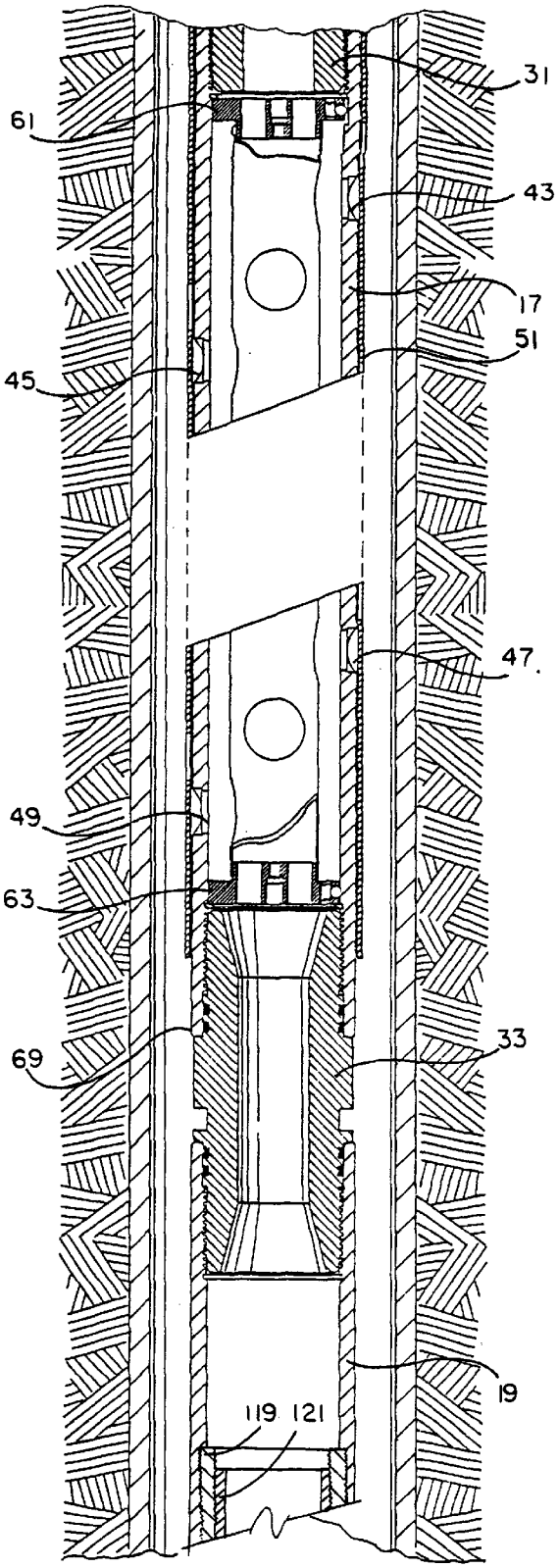
FIG. 3A is a view similar to FIG. 3 showing the apparatus after firing of the shaped explosive charges.

As shown in FIGS. 3 and 3A, piston sleeve 51 is mounted on the exterior of the tubular firing section 17. The piston sleeve 51 has a plurality of apertures 53, 55, 57, 59 which are initially aligned with the regions of reduced wall area 43, 45, 47, 49 in the tubular firing section and thus with the explosive charges.

While only one tubular firing section is illustrated, it will be understood that a plurality of such tubular sections can be connected end-to-end, in the tubular assembly. The firing sections are connected by any suitable ignition means for detonation by an associated firing means. In the example of FIG. 3, bi-directional boosters 61, 63 can be used to ballistically connect the various sections of the assembly. The booster sections 61, 63 include end caps having a central bore for receiving a det cord 65 for actuating the depending explosive charges. The boosters are commercially available from Owen Oil Tools, Inc., of Ft. Worth, Tex., and will be familiar to those skilled in the art. In the embodiment of the invention illustrated, the booster sections, e.g., section 61, are provided with vertical bores 62 (FIGS. 3 and 3A) which allow fluids to travel upwardly within the internal bore of the tubular firing section after detonation of the device.

Figure 2:
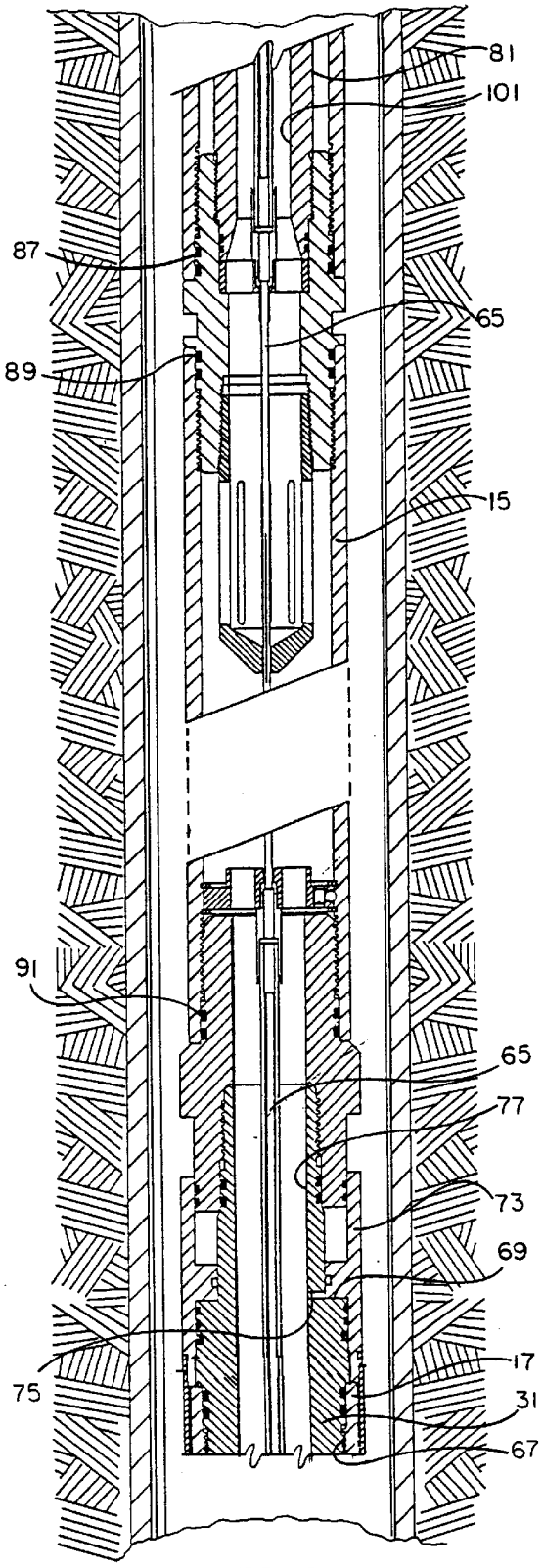
FIG. 2 is a downward continuation of FIG. 1 depicting the lower end of the firing head of the apparatus and the upper end of the tubular firing section thereof.

With reference to FIG. 2, the upper connector 31 has an externally threaded upper extent for engaging the mating internally threaded surface 67 of the tubular firing section 17. The lower connector 33 also has an external profile 69 (FIG. 3) which receives the lower most extent of the tubular firing section 17, thereby rigidly fixing the firing section in position.

Figure 2A:
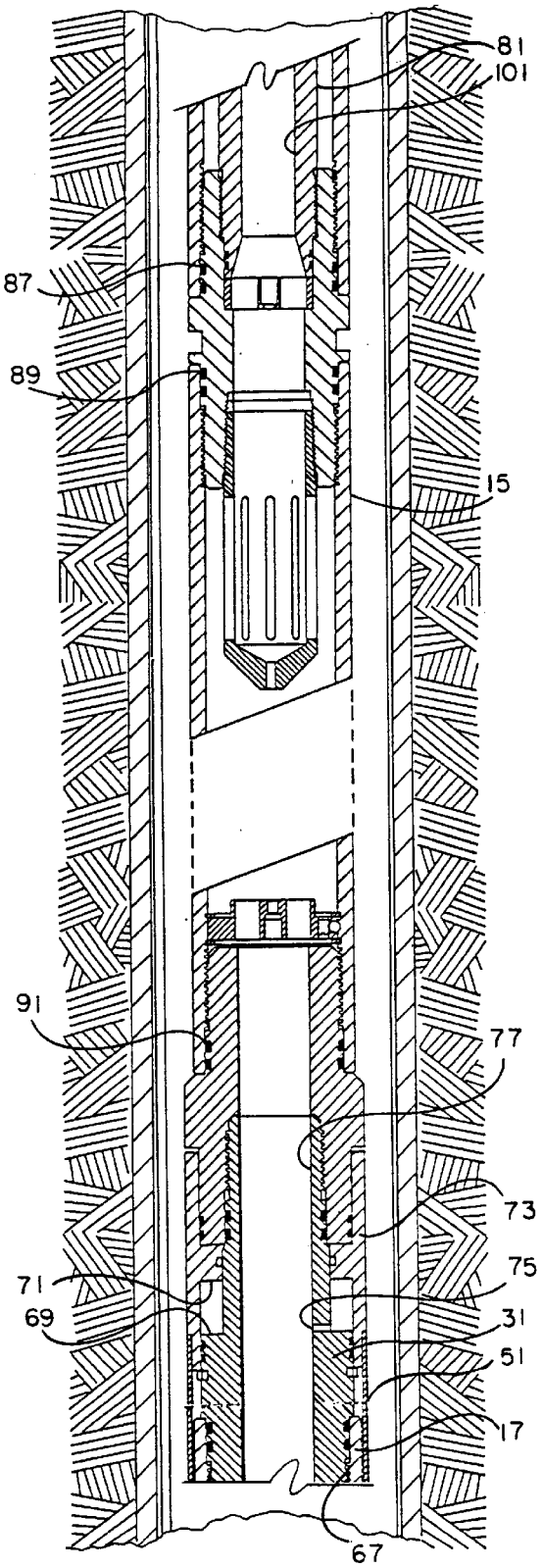
FIG. 2A is a side, cross-sectional view, similar to FIG. 2 showing the position of the apparatus after firing.

As shown in FIG. 2, the upper connector 31 has a region of stepped external diameter 69 which forms a ledge for receiving piston area 71 (FIG. 2A) of a piston actuator 73 which engages and supports the downwardly extending piston sleeve 51. An internal port 75 communicates the interior bore 77 of the tubular firing section 17 with the piston area 71, whereby detonation of the firing means and/or well bore hydrostatic pressure during and after detonation, applies a force to the piston area 71 to shift the piston sleeve 51 (see FIG. 2A). Firing of the exposive charges causes the regions of reduced wall area to be punctured, forming openings in the tubular firing section 17. Upon firing, the piston sleeve apertures 53, 55, 57, 59 shift out of alignment with the now formed openings 43, 45, 47, 49 in the tubular firing section 17 to trap any resulting explosive debris within the interior bore of the tubular firing section (see FIGS. 3 and 3A).

FIG. 1 and the top portion of FIG. 2 depict a TCP firing head which generally utilizes conventional components and will be familiar to those skilled in the art. The firing head 79 includes an outer tubular body 81 with an internal bore 83 which contains a length of det cord. Appropriately located O-ring seals 85, 87, 89, 91 isolate the internal bore 83. The det cord located within bore 83 can be ignited by a conventional firing means so that the downwardly continuing det cord 65 is, in turn, ignited, thereby actuating the depending shaped charges carried by the charge holder 29.

Figure 1A:
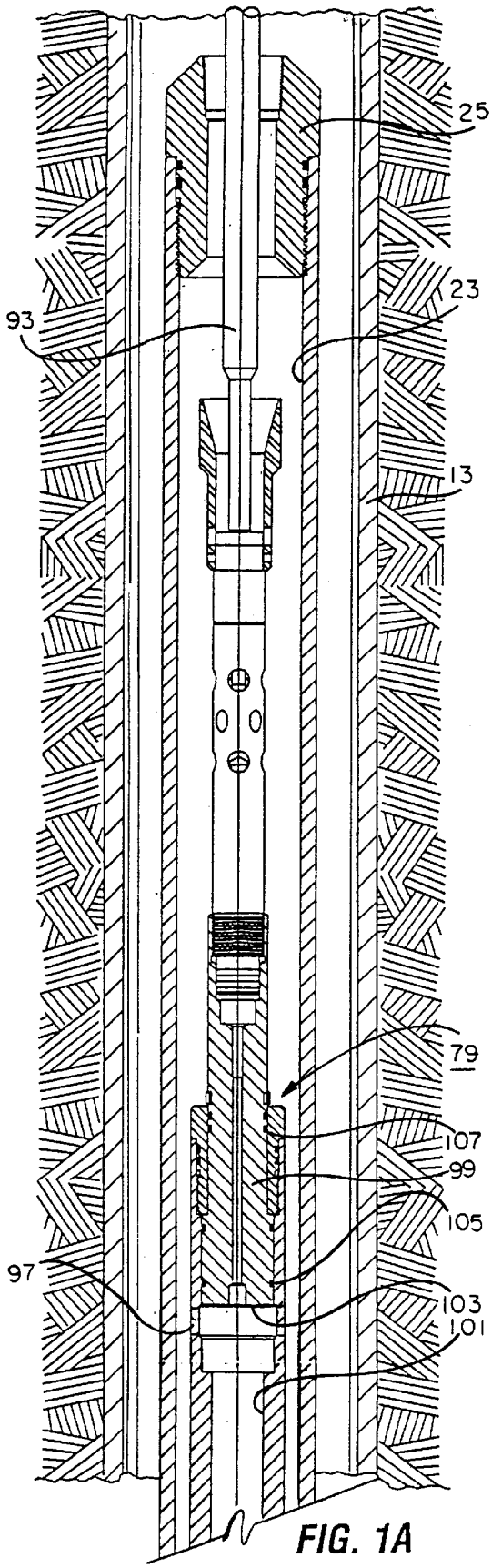
FIG. 1A is a side, cross-sectional view of the apparatus of FIG. 1 after detonation of the firing head.

Any convenient means can be utilized for firing the guns in the TCP apparatus. Typical techniques include drop-bar or "go-devil" systems, electrical firing systems or hydraulic systems. In FIGS. 1 and 1A, a conventional firing apparatus 93 is utilized to actuate the detonator 95 which ignites the various associated lengths of det cord.

In the particular embodiment of the invention illustrated, the firing head 79 includes a tubular sub 95 (FIG. 1) having upper circulating ports 97 located therein at one selected circumferential location. The upper circulating ports 97, as shown in FIG. 1, are initially closed off by means of the piston sub 99 located within the tubular sub 95. As shown in FIG. 1A, firing of the explosive charges generates explosive gases in the bore 101 which gases act upon the piston area 103 to drive the piston sub 99 upwardly, thereby uncovering the upper circulating ports 97. The piston sub 99 forms a sealing engagement with the surrounding tubular sub by means of appropriate O-ring seals such as seals 105, 107.

As will be apparent to those skilled in the relevant art, operation of all moving parts within the apparatus can be effected as a result of forces generated by the explosive gases generated by the explosive charges or as a result of well hydrostatic pressure communicated to the interior bore of the device. Thus, as an example, well bore hydrostatic pressure present during and after the firing of the explosive charges could be utilized to drive the piston sub 99 upwardly.

Figure 4:
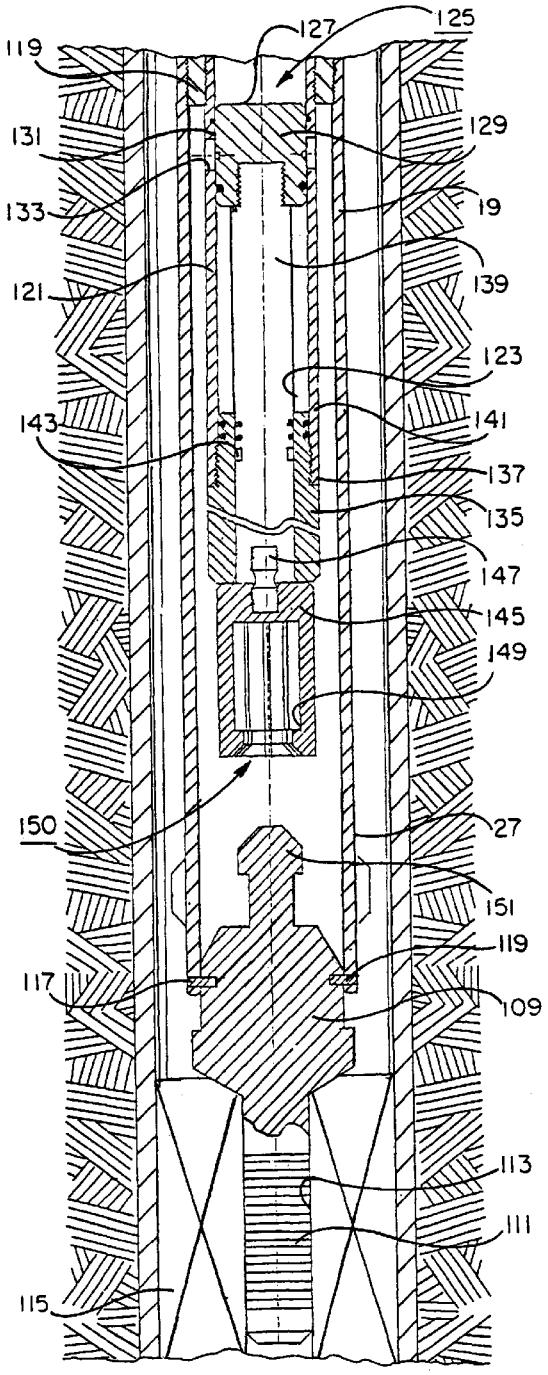
FIG. 4 is a downward continuation of FIG. 3 showing the lower end of the apparatus with the sealing plug thereof engaged within the bore of a sump packer located within the well bore.

FIGS. 3 and 4 illustrate the lower tubular section 19 of the apparatus and the internal components thereof. With reference to FIG. 4, the lower end 27 of the tubular section carries a sealing plug 109 having a stinger 111 which is designed to seat within a mating bore 113 of a sump packer 115. The sealing plug 109 is connected to the lower end 27 of the tubular assembly by an appropriate shearable connection such as shear pins 117, 119. In this manner, setting weight on the tubing string from the well surface shears the shear pins to release the lower end of the tubular assembly from the sealing plug 109.

Figure 4A:
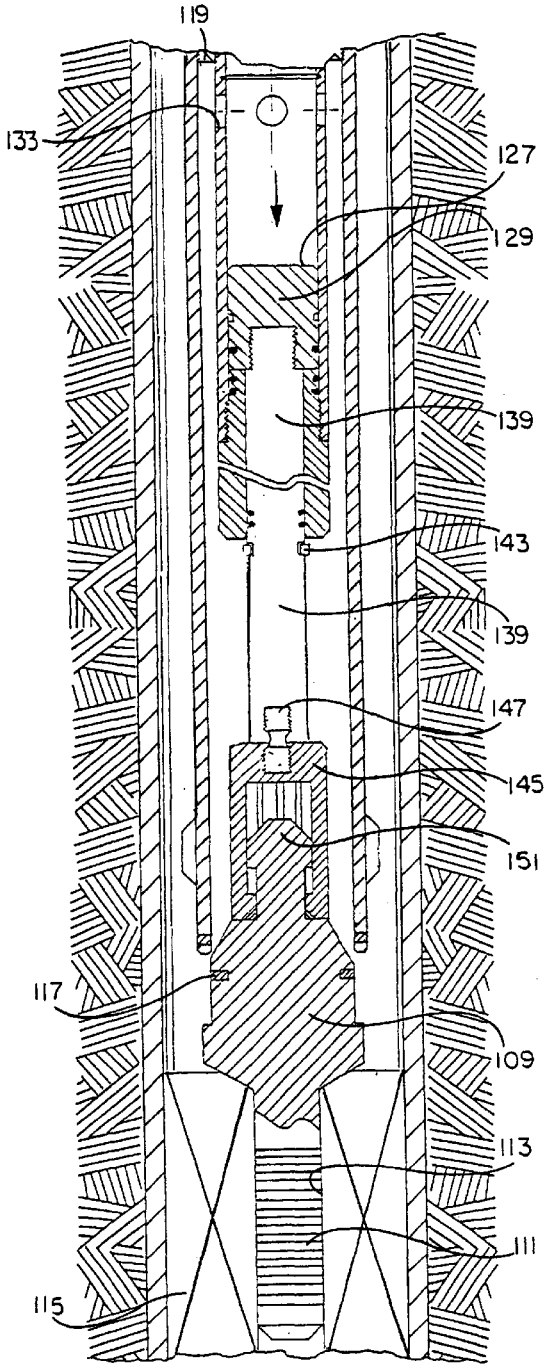
FIG. 4A is a view similar to FIG. 4 but showing the retrieving operation in which the retrieving assembly is shown engaging a mating surface of the sealing plug.

With reference to FIG. 3, the upper extent of tubular section 19 has an internally threaded surface 118 which carries a bull plug 119. The bull plug 119 has an externally threaded surface which engages the downwardly extending sleeve 121. Sleeve 121, has an internal bore 123 which, in turn, receives a piston actuated retrieving head 125 (FIG. 4). The retrieving head 125 has a reactive piston area 127 which comprises the end surface of an upper piston element 129. Piston element 129 has cylindrical external sidewalls 131 which, in the running-in position illustrated in FIG. 4, initially cover bottom circulation ports 133. The reactive piston area 127 is exposed to forces applied by the firing of the explosive charges and/or by exposure to well bore hydrostatic pressure, to shift the retrieving head downwardly within the sleeve 121, as shown in FIGS. 4 and 4A.

Sleeve 121 also has a bottom sub 135 threadedly engaged thereto. The bottom sub 135 has an internal bore 137 which slidingly receives the external cylindrical surface of the intermediate length 139 of the retrieving assembly. In addition to external O-ring seals 141, intermediate length 139 carries a latch ring 143 in a circumferential groove located on the external cylindrical surface thereof. As illustrated in FIG. 4A, downward movement of the intermediate length 139 allows the latch ring to expand outwardly, thereby locking the retrieving assembly in a lower, shifted position.

A fishing head 145 is carried at a lower extent of the intermediate length 139 of the retrieving assembly. Preferably, the fishing head 145 is attached to the intermediate length 139 by means of a shear stub 147. Collet fingers 149 extend downwardly from the fishing head and define a fishing opening 150 which is adapted to matingly engaging a nipple 151 provided on the sealing plug.

The operation of the device will now be described. The apparatus, as generally illustrated in FIGS. 1–4 is run into position within the well bore suspended from a tubing string extending to the well surface. The stinger 111 of the sealing plug 109 is inserted within the mating bore 113 of the sump packer (FIG. 4) previously set within the well bore. Weight is then applied via the tubing string, causing the shear pins 117 to sever, thereby freeing the tubular section 19 from the sealing plug, leaving the sealing plug in place within the sump packer. The tubing string is then lifted upwardly, usually a few feet, into the vicinity of the production interval and an upper packer in the tubing string (not shown) is set. The firing means is then actuated to detonate the explosive charges and fire the guns. The firing action and/or well hydrostatic pressure uncovers the upper circulating ports 97 in the upper end of the firing head. The firing action (and/or well hydrostatic pressure) also simultaneously shifts the piston sleeve 51 upwardly on the tubular firing section of the apparatus, thereby covering the openings which have been formed in the regions of reduced wall area provided in the tubular section 17 so that firing debris is trapped within the interior bore of the assembly (see FIGS. 3 and 3A). The explosive gases from the charges (and/or well hydrostatic pressure) also act upon the reactive piston area 127 of piston 129 (FIG. 4) to shift piston 129 and the retrieving assembly downwardly within the tubular section 19. This action exposes the bottom circulation ports 133 and locks the retrieving assembly in the extended position by means of the latch ring 143.

After perforating and stabilizing the well, the tubing string is continuously lowered, allowing sand to be circulated off the sealing plug. This is accomplished by circulating well bore fluids down the well annulus, up the lower end 27, through the bottom circulating ports 133 through the interior bore of the device and out the upper circulating ports 97 and up the tubing string to the well surface. Once any sand or debris has been removed from the upper surface of the sealing plug and sump packer, the work string can be lowered downwardly, thereby allowing the collet fingers of the retrieving head 145 to engage the nipple 151 of the sealing plug, as shown in FIG. 4A. By lifting the tubing string from the well surface, the sealing plug 109 can now be pulled out of engagement with the sump packer 115. If, for some reason, the plug 109 cannot be pulled from the packer, the shear stud 147 will sever, thereby allowing the system to be retrieved to the well surface.

An invention has been provided with several advantages. The combination perforating and circulating gun system saves time and effort, providing a one trip operation which replaces as many as three trips required in the prior art. The piston sleeve provided about the tubular firing section provides a convenient means for trapping any firing debris associated with the perforating operation. By providing a circulating system, sand or other debris can be reverse circulated out of the well to remove obstructions of sand or other contaminants located above a sump packer in a well bore. The reverse circulation operation can be accomplished without the necessity of tripping the work string from the well bore or requiring the presence of additional equipment. Reverse flow can also be utilized to remove other types of obstructions encountered in the well bore.

While the invention has been shown in only one of its forms, it is not thus limited but is susceptible to various changes and modifications without departing from the spirit thereof.

What is claimed is:

1. A tubing conveyed perforating apparatus used in perforating a surrounding well bore, the apparatus comprising:

a tubular assembly made up of a plurality of tubular sections, the tubular sections presenting a generally cylindrical exterior and a concentric interior bore, the tubular assembly having an upper connecting end for connection in a tubing string extending to the well surface and a lower end;

at least one selected tubular section comprising a tubular firing section having a plurality of explosive charges carried therein, each of the explosive charges being initially aligned with a region of reduced wall area provided within the tubular firing section surrounding the explosive charges;

a piston sleeve mounted on the exterior of the tubular firing section, the piston sleeve having a plurality of apertures therein which are initially aligned with the respective regions of reduced wall area provided in the tubular firing section and thus with the explosive charges;

a firing means located within the tubular assembly for detonating the explosive charges to puncture the regions of reduced wall area, thereby creating openings in the tubular firing section, while perforating the surrounding well bore;

pressure responsive means for applying a shifting force to the piston sleeve, whereby the piston sleeve apertures are moved out of alignment with the respective openings created in the tubular firing section to thereby trap any resulting debris within the interior bore of the tubular firing section.

2. The tubing conveyed perforating apparatus of claim 1, wherein the plurality of tubular firing sections are connected end to end in the tubular assembly, the firing sections being connected by ignition means for detonation by the firing means.

3. The tubing conveyed perforating apparatus of claim 2, wherein the firing means includes a tubular firing head located in the tubular assembly above the tubular firing sections.

4. The tubing conveyed perforating apparatus of claim 2, wherein the lower end of the tubular assembly carries a sealing plug which is designed to seat within a mating bore of a sump packer located within the well bore.

5. The tubing conveyed perforating apparatus of claim 4, wherein the sealing plug is connected to the lower end of the tubular assembly by shear means, whereby setting weight on the tubing string shears the shear means to release the lower end of the tubular assembly from the sealing plug.

6. The tubing conveyed perforating apparatus of claim 5, further comprising a piston actuated retrieving head located within the lower end of the tubular assembly above the sealing plug, the piston actuated retrieving head having a reactive piston area which is exposed to forces applied by the firing of the explosive charges to shift the retrieving head downwardly within the lower end of the tubular assembly.

7. The tubing conveyed perforating apparatus of claim 6, wherein the lower end of the tubular assembly is provided with at least one bottom circulation port for ultimately communicating the interior bore of the tubular assembly with the surrounding well annulus, movement of the piston actuated retrieving assembly downwardly within the tubular assembly serving to uncover the bottom circulation port.

8. The tubing conveyed perforating apparatus of claim 7, wherein the piston actuated retrieving assembly has a fishing head at a lower extent thereof which includes a fishing opening for engaging a mating surface provided on the sealing plug for retrieving the sealing plug from the bore of the sump packer.

9. The tubing conveyed perforating apparatus of claim 8, wherein the piston actuated retrieving assembly includes an intermediate length between the reactive piston area and the retrieving head, the intermediate length being provided with a latch means for locking the retrieving assembly in position.

10. The tubing conveyed perforating apparatus of claim 9, wherein the latch means is a collet carried circumferentially about the intermediate length of the retrieving assembly.

11. A tubing conveyed perforating apparatus used in perforating a surrounding well bore, the apparatus comprising:

a tubular assembly made up of a plurality of tubular sections, the tubular sections presenting a generally cylindrical exterior and a concentric interior bore, the tubular assembly having an upper connecting end for connection in a tubing string extending to the well surface and a lower end;

at least one selected tubular section comprising a tubular firing section having an elongate charge holder located therein between an upper connector and a lower connector;

a plurality of explosive charges mounted on the charge holder, each of the explosive charges being initially aligned with a region of reduced wall area provided within the tubular firing section surrounding the charge holder;

a piston sleeve mounted on the exterior of the tubular firing section, the piston sleeve having a plurality of apertures therein which are initially aligned with the respective regions of reduced wall area provided in the tubular firing section and thus with the explosive charges;

a firing means located within the tubular assembly for detonating the explosive charges to puncture the regions of reduced wall area, thereby creating openings in the tubular firing section, while perforating the surrounding well bore;

wherein the piston sleeve includes a piston area which communicates by means of an internal port with the interior bore of the tubular firing section, whereby detonation of the firing means applies a force to the piston area to shift the piston sleeve, moving the piston sleeve apertures out of alignment with the openings created in the tubular firing section to trap resulting debris within the interior bore of the tubular firing section.

12. A method of perforating a well bore having an upper borehole portion and a lower borehole portion including a production interval which is isolated from the well bore by a well casing or the like, the method comprising the steps of:

suspending a tubing conveyed perforating apparatus from a tubing string at a selected subterranean location within the well bore;

isolating the lower portion of the well bore from the upper portion thereof by means of a packer associated with the tubing string;

actuating the perforating apparatus to perforate the well casing adjacent the production interval to thereby allow production fluids to flow through the perforated interval upwardly to the well surface;

wherein the tubing conveyed perforating apparatus used to perforate the well casing includes a plurality of tubular sections having generally cylindrical exteriors and concentric interior bores, at least one of the tubular sections comprising a tubular firing section having a plurality of explosive charges carried therein, each of the explosive charges being initially aligned with a region of reduced wall area provided within the tubular firing section surrounding the explosive charges;

mounting a piston sleeve mounted on the exterior of the tubular firing section, the piston sleeve having a plurality of apertures therein which are initially aligned with the regions of reduced wall area provided in the tubular firing section and thus with the explosive charges;

providing a firing means located within the tubular assembly for detonating the explosive charges to puncture the regions of reduced wall area, thereby creating openings in the tubular firing section, while perforating the surrounding well bore;

providing pressure responsive means for applying a shifting force to the piston sleeve in response to detonation of the explosive charges;

actuating the pressure responsive means by firing the explosive charges to thereby shift the piston sleeve and move the piston sleeve apertures out of alignment with the respective openings created in the tubular firing section to thereby trap any resulting debris within the interior bore of the tubular firing section.

13. The method of claim 12, wherein the pressure responsive means is also acted upon by well bore hydrostatic pressure which is communicated to the interior bore of the tubing conveyed perforating apparatus upon firing of the explosive charges and forming the openings in the tubular firing section of the apparatus.

14. A method of perforating a well bore with a perforating apparatus run on a tubing string, the well bore having a sump packer located at a selected subterranean location, the sump packer having a packer bore therethrough, the method comprising the steps of:

providing a perforating apparatus carried by the tubing string which includes a plurality of tubular sections having generally cylindrical exteriors and concentric interior bores, at least one of the tubular sections comprising a tubular firing section having a plurality of explosive charges carried therein, each of the explosive charges being initially aligned with regions of reduced wall area provided within the tubular firing section surrounding the charges;

the lower end of the tubular assembly being provided with a sealing plug which is designed to seat within the bore of the sump packer located within the well bore;

the sealing plug being connected to the lower end of the tubular assembly by shear means, whereby setting weight on the tubing string shears the shear means to release the lower end of the tubular assembly from the sealing plug; and wherein the tubular firing section is surrounded by a shifting sleeve which has apertures which initially are aligned with the regions of reduced wall area provided in the tubular firing section, the shifting sleeve being shiftable upon firing of the explosive charges to vertically displaced position which covers any openings formed in the tubular firing section by detonation of the charges to thereby retain any resulting debris within the interior bore of the tubular firing section.

15. The method of claim 14, wherein the lower end of the tubular assembly is provided with at least one bottom circulation port for ultimately communicating the interior bore of the tubular assembly with the surrounding well annulus, movement of the piston actuated retrieving assembly downwardly within the tubular assembly serving to uncover the bottom circulation port.

16. The method of claim 15, wherein the piston actuated retrieving assembly is provided with a fishing head at a lower extent thereof which includes a fishing opening for engaging a mating surface provided on the sealing plug for retrieving the sealing plug from the bore of the sump packer.

17. The method of claim 16, wherein the piston actuated retrieving assembly is provided with an intermediate length between the reactive piston area and the retrieving head, the intermediate length being provided with a latch means for locking the retrieving assembly in the lower, shifted position.

18. The method of claim 17, comprising the steps of:

lowering the well tubing string downwardly within the well bore until the sealing plug is received within the packer bore;

continuing to apply downward weight on the tubing string to shear the shear means to release the lower end of the tubular assembly from the sealing plug.

19. The method of claim 18, further comprising the steps of:

moving the tubing string upwardly and then detonating the explosive charges to thereby shift the piston actuated retrieving assembly downward within the lower end of the tubular assembly, downward movement of the retrieving assembly serving to uncover the bottom circulation port.

20. The method of claim 19, further comprising the steps of:

while continuously lowering the assembly downwardly within the well bore, washing any accumulated debris from off the sump packer by circulating fluid down the well annulus, through the bottom circulating port and up the interior bore of the assembly and tubing string to the well surface.

21. The method of claim 20, further comprising the steps of:

continuing to lower the assembly downward until the retrieving head engages the sealing plug;

pulling the assembly upward to thereby pull the engaged sealing plug upwardly out of the packer bore.

22. The method of claim 12, wherein the tubing conveyed perforating apparatus is also provided with a piston actuated retrieving head located within the lower end of the tubular assembly above the sealing plug, the piston actuated retrieving head having a reactive piston area which is exposed to forces applied by the firing of the explosive charges to shift the retrieving head downwardly within the lower end of the tubular assembly.

* * * * *